US005225042A

United States Patent [19]

Eaton et al.

[11] Patent Number: 5,225,042

[45] Date of Patent: Jul. 6, 1993

[54] TWIN WIRE PAPER FORMING SECTION WITH HEATED AIR PRESSURE DOMES

[75] Inventors: Daniel J. Eaton; Roger A. Kanitz, both of Beloit, Wis.

[73] Assignee: Beloit Technologies, Inc., Wilmington, Del.

[21] Appl. No.: 801,284

[22] Filed: Dec. 2, 1991

[51] Int. Cl.[5] ..... D21F 1/00

[52] U.S. Cl. ..... 162/203; 162/207; 162/290; 162/301; 162/307

[58] Field of Search ..... 162/300, 301, 306, 307, 162/203, 207, 290

[56] References Cited

U.S. PATENT DOCUMENTS

| | | | |
|---|---|---|---|
| 3,311,533 | 3/1967 | De Montigny et al. | 162/203 |
| 3,810,818 | 5/1974 | Arledter | 162/301 |
| 3,844,881 | 10/1974 | Moody | 162/300 |
| 3,846,233 | 11/1974 | Kankaanpaa | 162/312 |
| 3,997,390 | 12/1976 | Kanakaanpaa | 162/203 |
| 4,459,175 | 7/1984 | Bubik et al. | 162/297 |
| 4,790,909 | 12/1988 | Harwood | 162/301 |
| 4,808,266 | 2/1989 | Faurie | 162/203 |

*Primary Examiner*—Karen M. Hastings
*Attorney, Agent, or Firm*—Dirk J. Veneman; Raymond W. Campbell; Gerald A. Mathews

[57] ABSTRACT

A method and apparatus for improved dewatering of a papermaking stock in a web forming section of a papermaking machine including directing a stock jet stream into the head end of a run between opposed looped forming wires traveling in a substantially parallel forming run passing over a curved vacuum forming box and thereafter passing over one or more pressure locations with a pressure dome on one side and a water collecting chamber at the other side of the wires with the pressure dome in one form divided into compartments each applying an increasing pressure to the wire and stock between the wires with the air pressure being heated such as by being delivered from the dryer section and the wires separated slightly following the pressure location with a last smaller pressure compartment transferring the web to one of the wires and the wire carrying the web thereafter turning over a couch roll and the other wire carried over a turning roll.

3 Claims, 3 Drawing Sheets

TWIN WIRE PAPER FORMING SECTION WITH HEATED AIR PRESSURE DOMES

BACKGROUND OF THE INVENTION

The invention relates to improvements in papermaking machines, and more particularly to an improved method and apparatus for a web forming section of a papermaking machine.

In technical advances in papermaking machines, one of the more important developments is in the initial web forming inasmuch as with demands for increased papermaking speeds, the overall machine cannot be operated any faster than the initial web forming dewatering section. Advances have included for the fourdrinier section, a two wire forming section for increasing the efficiency and speed of the dewatering process and turning out a web which avoids the disadvantages of a two sided resultant paper web.

Accompanying demands for high quality and increased speed in the papermaking machine, the papermaking industry is becoming increasingly concerned with lowering both the manufacturing and operating costs of the equipment. In formers this means that they must be constructed with less structure and lower operating costs and simpler components which require less electricity and energy costs. Also important from the papermaker's standpoint is that the resultant machine must provide quick and ready access for changing and replacing components such as foil blades, forming wires, and for cleaning out accumulations of dirt, slime and fibrous conglomerations which accrue on the component parts during operation.

In one type of former which has become highly commercially successful, twin looped forming wires are guided through a vertical dewatering path in substantial parallelism with the stock jet delivered at the lower end of the vertical forming run. In such equipment it is, of course, necessary to guide the forming wires at the end of the run and in certain constructions, the web is transferred to an inner forming wire and it has been essential to guide the outer forming wire over a top arm construction that is large and massive. Such construction requires the building housing the equipment to be taller and requires space over the former for a crane to pass. This also requires more maintenance and because of extending the height of the overall former, the unit tends to vibrate and lower the natural frequency of the entire former. Since it is desired to increase machine speeds in order to increase production, anything which contributes to the lowering of the natural frequency is undesirable.

A further disadvantage of existing structures has been the requirement of equipment to provide a vacuum for withdrawing water from the stock through the lower wire. Such vacuum apparatus requires fan pumps and air and water removal ducts. Vacuum glands have to be provided within the couch roll beneath the arcuate segment of the roll covered by the forming wires as the web is turned and transferred onto the lower forming wire. In addition the entire forming zone extending between the breast roll and couch roll is curved which requires accurate machining of both ceramic blade elements as well as support structure on which the blades are mounted. In this type of structure, vacuum pressure is utilized both beneath the initial forming shoe located just downstream of the breast roll as well as the downstream suction box or boxes. Both of these have been conventionally located within the inner or lower forming wire. Vacuum forming and dewatering has been successful but has required a substantial amount of equipment such as in the form of separators for separating and removing air from the water and keeping the air and water separate while removing them from the former. Also, due to the forming shoe and suction box both being disposed within the inner or lower forming wire, paper two-sidedness can become a problem unless the former is run at relatively higher speed, such as 3,000 to 4,000 feet per minute depending on the paper grade to permit the deflectors to operate to remove sufficient water to make the paper more one sided.

Vacuum water removal also requires a lot of electrical power in order to maintain the full extent of the duct work connected with the forming shoe under vacuum pressure while creating and maintaining the flow of air through the web to effect dewatering over the forming shoe.

Another problem which exists connected with vacuum dewatering is that the tendency of the subatmospheric air pressure in the chamber beneath the forming wire will either distend the forming wire away from the web or distend both the web and the forming wire under the web into the gap between adjacent dewatering blades. This tends to place limits on the vacuum applied or requires closer spacing between the blades. In any event, it places more limitations on the flexibility afforded the papermaker in operating the machine.

FEATURES OF THE INVENTION

It is an object of the present invention to provide an improved web forming section of a papermaking machine which avoids the disadvantages attendant with present commercial twin wire forming machines which utilize vacuum dewatering and vacuum web transfer to one of the wires following the forming section.

A further object of the invention is to provide a structure and principle of operation for twin wire forming machines wherein the massive equipment and particularly the massive arm supporting the turning roll carrying the forming wire is avoided to avoid lowering the natural frequency of the machine.

A further object of the invention is to provide an improved method and apparatus for transferring a web to one of the wires in a twin wire run of a papermaking machine.

In accordance with the features of the invention, air under pressure is utilized for dewatering rather than utilizing subatmospheric air pressure. Air under pressure is also utilized for transferring the web to be lower at the wire at the end of the forming run for effective transfer and to reduce the size and bulk of the machinery required and thereby reduce the cost of construction and to avoid reduction in the natural vibrational frequency.

Air under pressure is supplied to a sequence of compartments in close-running relationship with one of the wires in a twin wire former and the motor supplying this air does not have to be large in order to drive a compressor fan of suitable capacity to supply the air required. Air under pressure in a pressure dome does not require the electrical energy which would be required if vacuum pressure were applied to a duct for drawing water from the fibers of the stock being formed between twin wires. Vacuum pressure requires that the entire duct work of the former be maintained under vacuum pressure. Whereas where air pressure is used, only the relatively narrow diameter pipes leading to the pressure dome need be maintained under super-atmospheric air pressure. The power required for pressure systems as contrasted with vacuum systems is substantially less thereby decreasing the operating cost of the former.

In the twin wire former constructed in accordance with the invention, an initial forming shoe is used which utilizes suction and removes water which is rich in fiber and filler content which is collected separately from water collected by air pressure. The water extracted from the web by air pressure is relatively lean and can be recycled through the papermaking machine.

Another feature of utilizing air pressure is that the air is heated to impinge upon the web thereby effecting a more efficient separation of the water from the fibers in the web. Air supplied to the pressure dome is collected from the dryer section where air has been heated by the many steam heated dryer rolls so that this heated air is obtained at no extra cost. A so-called water-ring type pump which can incorporate a water ring to isolate air from water collects heated air, pressurizes it and directs it into the pressure dome compartments to be impinged upon and partially passed through the paper web carried through the forming zone. This heated air which otherwise would be wasted in the dryer section, tends to lower the viscosity of the water in the web in the forming section so as to improve the water removal efficiency.

It has been determined that by utilizing the arrangement wherein an initial removal is accomplished by a forming shoe and thereafter removal is performed by air pressure domes, that the one-sidedness of the paper is improved. By utilizing air pressure for transfer of the web at the end of the forming run, the equipment used for the turning roll in the looped top forming wire is considerably smaller and is mounted considerably lower than structures heretofore available. The arrangement is pivoted at a point well within the apparatus so as to allow easier and more extensive access to the forming zone for cleaning component replacement and adjustment.

The forming zone utilizing pressure domes is arranged with the wires running in a substantially straight linear path which substantially reduces the cost of production of individual foil blades. These foil blades are more easily machined with a flat surface for contacting the forming wire. The structure on which the forming blades are mounted can be machined flat which provides for an easier and cheaper manufacturing process.

With the water being removed by pressure, the duct work on the water receiving side of the forming wire does not require vacuum pressure. The water can thereby be discharged by gravity and there is no need for equipment to separate air from the water.

Following the transfer to the lower wire by air pressure, the couch roll need not be equipped with a vacuum gland to effect or promote web transfer. This substantially reduces the design and construction cost of the couch roll.

Other objects, advantages and features will become more apparent with the teaching of the principles of the invention in connection with the disclosure of the preferred embodiment in which:

DESCRIPTION OF THE PREFERRED EMBODIMENT

Figure 1:
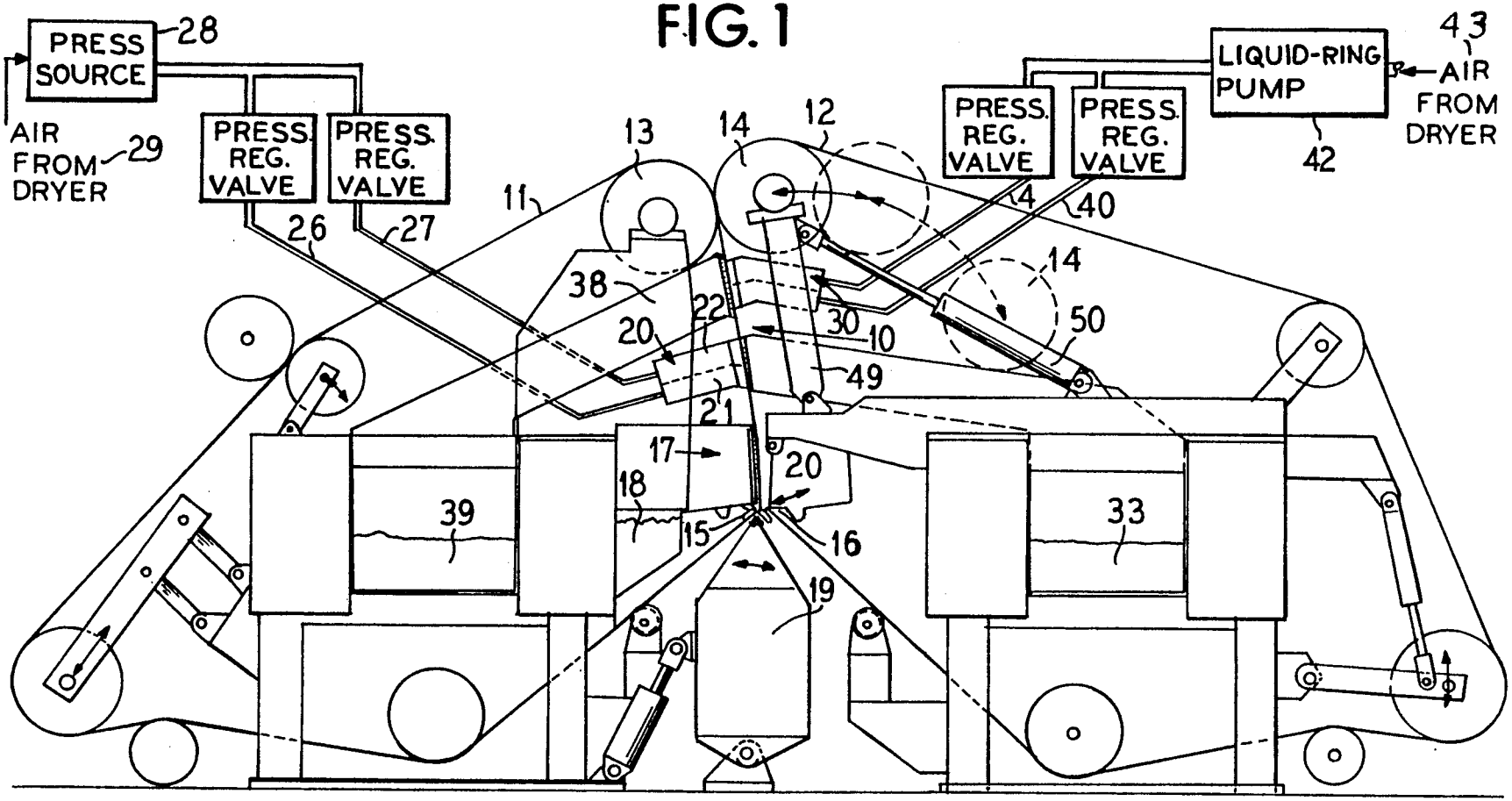
FIG. 1 is an overall elevational view of a forming section of a papermaking machine constructed and operating in accordance with the principles of the present invention.

As illustrated in FIG. 1, twin looped forming wires 11 and 12 are guided in a run and brought together in a forming run 10 during which run paper stock between the wires is dewatered and a web is initially formed. The looped forming wires 11 and 12 are carried on a series of rolls, which are not numbered and which can take various forms, will be fully recognized by those versed in the papermaking art and the support rolls for the looped forming wires 11 and 12 are therefore not specifically numbered or described relative to their position in FIG. 1 which may be fully observed.

At the entry end of the forming zone 10, the wires are trained over curved shoes 15 and 16 into a throat 20. Papermaking stock is delivered into the throat by a jet delivered from a pressure headbox 19 which can be adjusted so as to provide the right trajectory for the stock.

Figure 2:
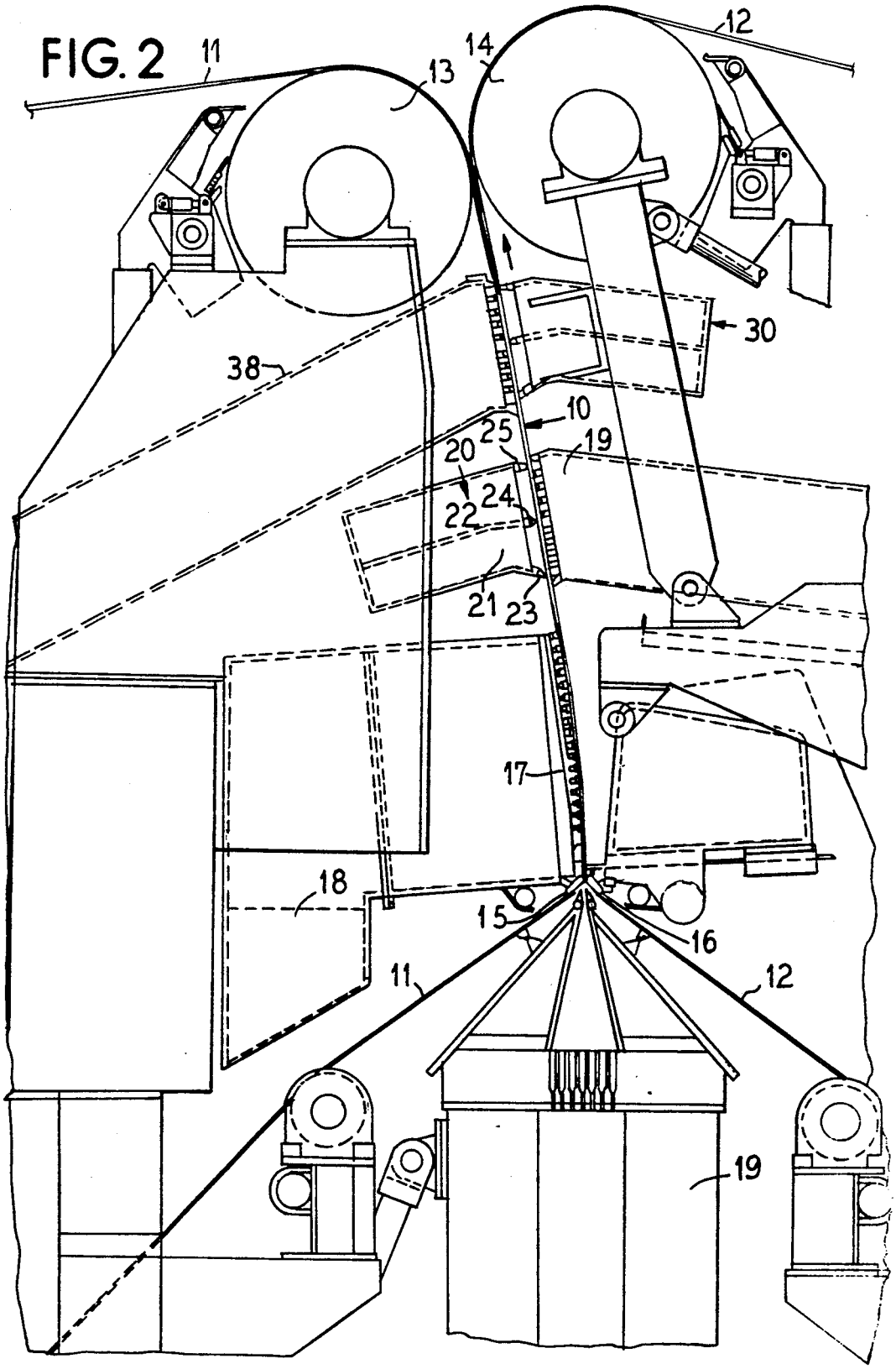
FIG. 2 is an elevational view somewhat enlarged from FIG. 1 illustrating further details of the forming section.

As shown in FIGS. 1 and 2, the twin forming wires 11 and 12 first pass over an arcuate curved suction box 17 where suction is applied to first begin the dewatering of the stock and water removed therefrom is received into a chamber 18 where it is removed to be further treated such as by removing the excess of fibers.

Following the arcuate suction box 17, the web is led through a fairly straight linear dewatering path where it is subjected to air pressure. The air pressure is preferably applied in two air pressure domes 20 and 30 with air first being applied from the inside of the lower wire 11 and then subsequently applied to the inside of the upper wire 12.

The pressure dome 20 may be divided into a series of compartments such as illustrated at 21 and 22 and the pressure compartments are sealed to prevent the escape of air by shoes 23, 24 and 25 in close-running relationship with the under surface of the lower wire 11.

As shown in FIG. 1, compartment 21 of the air dome from a line 26 supplied by a pressure control valve from a pressure source 28 which preferably receives heated air from the dryer section shown schematically at 29.

The second compartment 22 receives air at a slightly higher pressure from a line 27 controlled by a pressure regulator valve receiving air from the same pressure source 28. The air forces water from the web being formed into a water receiving chamber 19 located opposite the pressure location and the water can flow gravitationally to a water receiving tank 33. The water can be recirculated for mixing with fresh stock.

Following the first pressure location is a second pressure location with a second pressure dome 30. The pressure dome 30 is also comprised of a series of pressure chambers each maintained at a successively slightly higher pressure. The water forced from the fibers being formed into a web is received by a water collecting chamber 38 positioned at the second pressure location and the water flows gravitationally to a water receiving tank 39.

Figure 3:
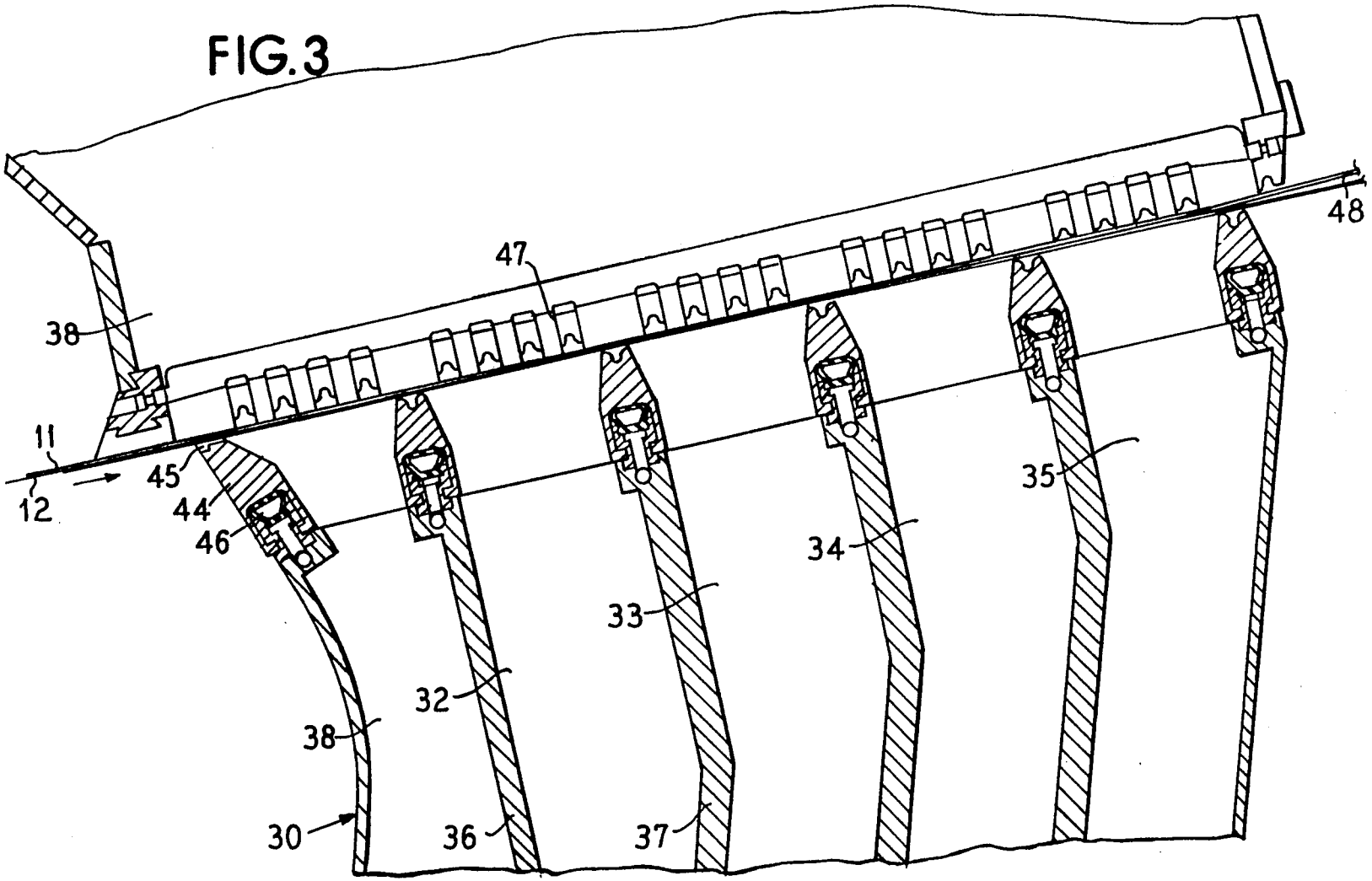
FIG. 3 is a fragmentary sectional view of a portion of the air pressure dome where water is removed from the web.

While each of the pressure domes 20 and 30 are illustrated in FIGS. 1 and 2 as schematically having two successive pressure chambers, it is preferred that a series of pressure chambers be provided such as illustrated in FIG. 3. There successive pressure chambers are shown at 31, 32, 33, 34 and 35 separated by walls between the chambers such as shown at 36 and 37. Air pressure in chambers 31–34 preferably varies in successive downstream chambers from about 0 psi to 10 psi. The preferred transfer pressure in chamber 35 is about 2.5 psi.

The edges of the chambers in close-running relation to the wire 12, are shoes which separate the chambers and prevent the escape of air pressure. The shoes, such as 44, have a tip 45 in close-running relation with the wire and are locked by a resilient pressure member 46 at the edge of the compartment walls. Each of the shoes can be similarly constructed and need not be described in detail.

At the opposite side of the pressure zone, the water receiving chamber 38 (and 19) has a plurality of skimming blades 47 which are in close-running relation with the inner wire 11 to remove water therefrom and cause the water to flow gravitationally down into the chamber 31.

At the end of the dewatering zone, the web is transferred to the lower wire 11 as shown by the web 48. For this purpose, the turning rolls 13 and 14 are positioned to cause a slight separation in the wires on the order of 0.030". The air pressure transfer chamber 35 will be pressurized on the order of 2.5 psi which is sufficient to transfer the web to the lower wire 11 so that it will adhere to the wire and travel over the turning couch roll 13. The angle of divergence of the wires can be controlled by adjusting the turning roll 14 as shown in FIG. 1 and the turning roll 14 is carried on a pivotal arm 49 operated by a hydraulic piston and cylinder 50. The pivotal arm can also move the turning roll 40 down to the dotted line position shown for changing wires. Thus, it will be seen that the operating mechanism for the turning roll 14 can be located within the framework of the machine reducing the height of the machine. Also, the pipes for supplying air pressure can be relatively small and led out the side of the machine to the back side of the former. Similarly, pipes for removing the water from the containers 33 and 39 can be led out of the back side of the machine thereby reducing the total height of the machine and avoiding reduction of the natural frequency. In present operating commercial machines, speeds of 3,500 to 6,000 feet per minute are expected so that construction must be utilized which does not reduce the natural frequency and the present arrangement is particularly adapted to such machine design.

In operation, as illustrated in FIGS. 1 and 2, stock is delivered from a headbox 19 to the slice throat leading to the forming run 10. The wires which are initially trained over curved shoes 15 and 16 pass over a curved suction box 17 for initial dewatering. The wires then pass into a relatively straight linear run to pass over first and second pressure domes 20 and 30 where air pressure is applied successively on opposite sides of the twin parallel wires 11 and 12. Air pressure is increased incrementally in the direction of wire run. At the end of the run, as illustrated in FIG. 3, the wires are slightly separated and the last pressure compartment 35 forces the web away from the upper wire 12 transferring it to the lower wire 11 where it travels around the couch roll 13 separated from the wire 12.

Thus there has been provided an improved twin wire machine which is capable of operation at high commercial speeds and presents a machine which can be constructed of reduced cost utilizing air pressure pipes rather than expensive space consuming vacuum ducts. The dewatering run passing over pressure domes provides a straight line run allowing for construction of blades and shoes having flat surfaces and supports which avoid the necessity of careful design to match a predetermined arc. The machine provides a low silhouette, low center of gravity arrangement which is easy to construct and assemble as contrasted with high profile machines of the type heretofore available.

I claim as my invention:

1. A method of dewatering paper stock and forming a paper web in a web forming section of a papermaking machine, comprising the steps:

delivering stock directly into a gap between a pair of opposed looped forming wires guided in substantial parallelism to define a substantially straight web forming dewatering run which extends in an upwardly direction;

dewatering the stock by a first dewatering means which includes a curved forming shoe within one of the looped forming wires and over which the forming wires are trained to subject the stock to vacuum pressure through the said one of the looped forming wires;

continuing dewatering the stock downstream of the curved forming shoe by subjecting a first of the forming wires to heated air pressure at a first pressure location within the first forming wire along the forming run for forcing water from the stock between the wires;

collecting the water in a first chamber located within the looped second forming wire at the opposing side of the pressure location said first chamber having a plurality of skimming blades in close running relationship with the second forming wire;

continuing dewatering the stock along the run after the first pressure location by subjecting the second of the forming wires to heated air pressure at a second pressure location along the forming run for forcing water from the stock between the wires;

and collecting the water in a second chamber located within the looped first forming wire at the opposing side of the second pressure location, said second chamber having a plurality of skimming blades in close running relationship with the first forming wire.

2. A paper web forming section of a papermaking machine comprising, in combination:

a pair of opposed looped forming wires guided into substantial parallelism to define a substantially straight web-forming dewatering run therebetween which extends in an upwardly direction;

means for delivering a stock jet stream at a head end of the run between the forming wires, said means positioned directly adjacent the start of the dewatering run;

a web-forming vacuum shoe positioned near the beginning of said dewatering run in close-running relationship with the forming wires, and means for apply a vacuum to said vacuum shoe;

a first stationary pressure dome positioned downstream from said vacuum shoe and within one of the forming wires at a pressure location along the dewatering run with a pressure compartment opening in close-running relationship with said one of the forming wires for applying a dewatering pressure to stock being dewatered along said run;

a second stationary pressure dome positioned downstream of said first pressure dome at a second pressure location within the other forming wire along the dewatering run with a pressure compartment opening in close-running relationship with the said other forming wire for applying a dewatering pressure to stock being dewatered along said run;

an air pressure means delivering air under pressure to said first and second pressure domes for applying the dewatering pressure;

means for heating the air of said air pressure means so that air delivered through the stock between the wires will be heated to enhance effective dewatering;

and a water collecting chamber at each pressure location within each of said looped forming wires and opposite a corresponding pressure dome, each said chamber having a plurality of skimming blades in close running relationship with a corresponding wire so that water expressed from the web is received in said chambers.

3. A paper web forming section of a papermaking machine constructed in accordance with claim 2, wherein:

the means for heating the air includes means leading from a dryer section of the papermaking machine delivering heated air to each pressure dome so that heated air will pass through the wires for improved dewatering of the web.

* * * * *